US010865779B2

(12) United States Patent
Lee et al.

(10) Patent No.: US 10,865,779 B2
(45) Date of Patent: Dec. 15, 2020

(54) METERING PUMP FOR A METERING DEVICE AND METERING DEVICE

(71) Applicant: F. Holzer GmbH, St. Ingbert (DE)

(72) Inventors: Hyeck-Hee Lee, St. Ingbert (DE); Ute Steinfeld, St. Ingbert (DE); Markus Mahler, Völklingen (DE); Frank Holzer, St. Ingbert (DE)

(73) Assignee: F. Holzer GmbH, St. Ingbert (DE)

( * ) Notice: Subject to any disclaimer, the term of this patent is extended or adjusted under 35 U.S.C. 154(b) by 0 days.

(21) Appl. No.: 16/087,407

(22) PCT Filed: Mar. 21, 2017

(86) PCT No.: PCT/EP2017/056672
§ 371 (c)(1),
(2) Date: Sep. 21, 2018

(87) PCT Pub. No.: WO2017/162655
PCT Pub. Date: Sep. 28, 2017

(65) Prior Publication Data

US 2019/0101108 A1 Apr. 4, 2019

(30) Foreign Application Priority Data

Mar. 24, 2016 (DE) ..... 10 2016 204 953

(51) Int. Cl.
*F04B 9/14* (2006.01)
*F04B 53/12* (2006.01)
*B05B 11/00* (2006.01)

(52) U.S. Cl.
CPC ..... *F04B 9/14* (2013.01); *B05B 11/0032* (2013.01); *B05B 11/3001* (2013.01);
(Continued)

(58) Field of Classification Search
CPC ..... F04B 9/14; F04B 53/12; F04B 53/121; B05B 11/0032; B05B 11/3001;
(Continued)

(56) References Cited

U.S. PATENT DOCUMENTS 5,195,665 A * 3/1993 Lina ..... B05B 1/14 222/496
5,373,972 A * 12/1994 Bystrom ..... A61F 9/0008 222/212

(Continued)

FOREIGN PATENT DOCUMENTS

| | | |
|---|---|---|
| EP | 0795354 A2 | 9/1997 |
| EP | 1380351 A1 | 1/2004 |
| FR | 2993542 A1 | 1/2014 |

OTHER PUBLICATIONS

"International Application Serial No. PCT/EP2017/056672, International Search Report dated Jul. 4, 2017", w/ English Translation, (dated Jul. 4, 2017), 7 pgs.

(Continued)

*Primary Examiner* — Paul R Durand
*Assistant Examiner* — Andrew P Bainbridge
(74) *Attorney, Agent, or Firm* — Schwegman Lundberg & Woessner, P.A.

(57) ABSTRACT

The present invention relates to a metering pump for a metering device, the metering pump being connectable to a storage container. The metering pump thereby comprises a non-return valve which has sealing elements on the base-side, which sealing elements enable internal sealing of the metering pump. In addition, the present invention relates to a metering device in which the metering pump according to the invention is connected to a storage container.

18 Claims, 10 Drawing Sheets

Figure 1:
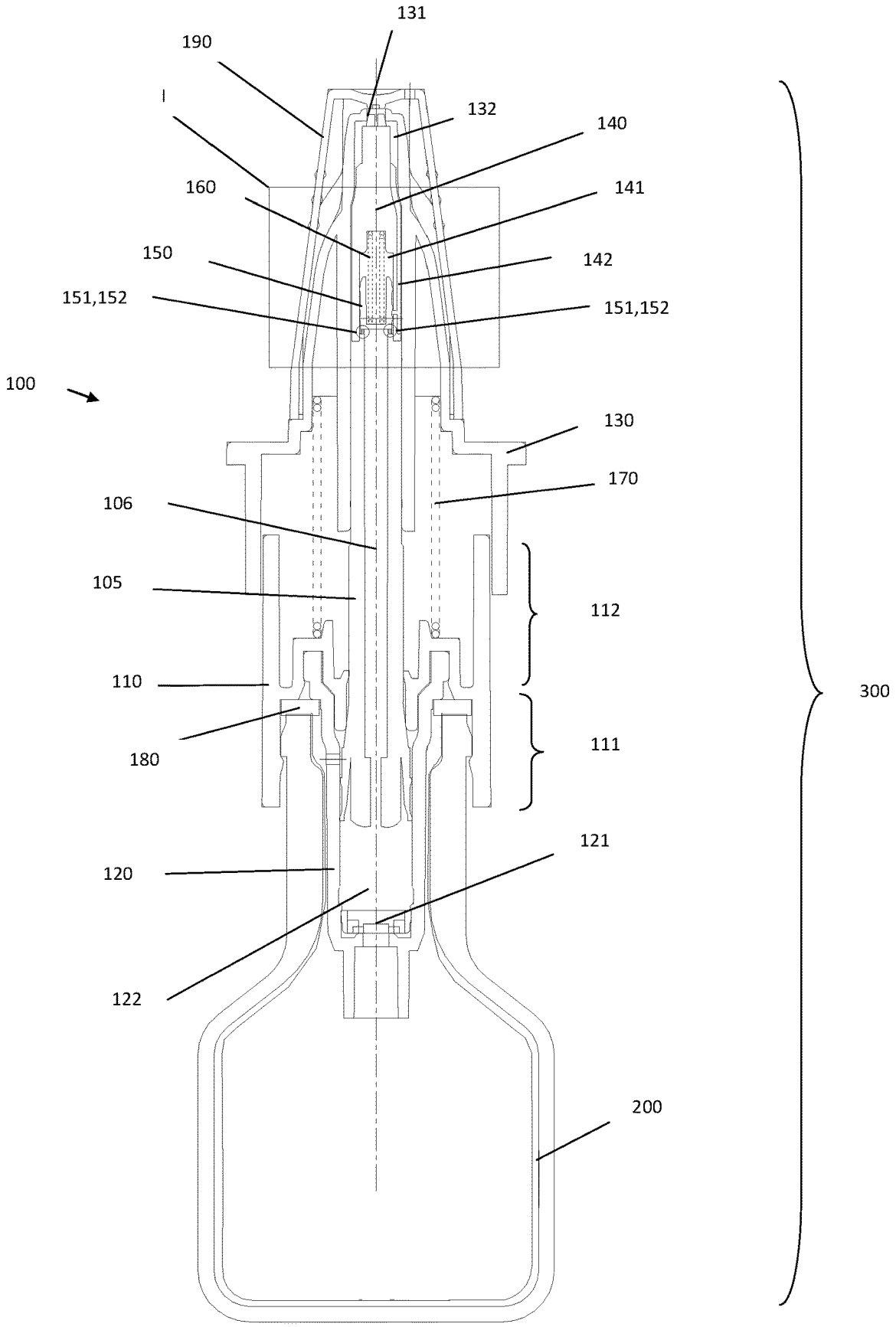

(52) U.S. Cl.
CPC ..... *B05B 11/305* (2013.01); *B05B 11/3047* (2013.01); *F04B 53/12* (2013.01); *F04B 53/121* (2013.01); *B05B 11/304* (2013.01); *B05B 11/3074* (2013.01)

(58) Field of Classification Search
CPC . B05B 11/3047; B05B 11/305; B05B 11/304; B05B 11/3074
USPC ..... 222/321.2, 321.6
See application file for complete search history.

(56) References Cited

U.S. PATENT DOCUMENTS 5,614,172 A * 3/1997 Geimer ..... A61F 9/0008 424/405
5,655,689 A * 8/1997 Fuchs ..... B05B 11/0005 222/321.2
6,053,368 A * 4/2000 Geimer ..... A61L 2/16 222/189.09
6,095,376 A * 8/2000 Hennemann ..... A61L 2/16 222/190
6,776,312 B2 * 8/2004 Masuzzo ..... B05B 11/007 222/321.7
6,824,021 B2 * 11/2004 Masuzzo ..... B05B 11/0072 222/321.7
6,851,583 B2 * 2/2005 Masuzzo ..... B05B 11/0005 222/321.6
8,985,401 B2 * 3/2015 Welp ..... B05B 11/0067 222/321.8
2004/0200860 A1 * 10/2004 Buxmann ..... B05B 11/0032 222/321.6
2005/0173459 A1 * 8/2005 Buxmann ..... B05B 11/0032 222/321.6
2009/0277928 A1 * 11/2009 Bruckner ..... B05B 11/0078 222/129
2010/0176158 A1 * 7/2010 Carta ..... B05B 11/3023 222/321.9
2012/0197219 A1 * 8/2012 Scanlon ..... A61F 9/0008 604/295
2013/0200110 A1 * 8/2013 Lee ..... B05B 11/0064 222/321.6
2015/0335823 A1 * 11/2015 Weikart ..... C23C 16/045 604/187
2017/0291183 A1 * 10/2017 Lee ..... B05B 11/0005
2019/0101108 A1 * 4/2019 Lee ..... B05B 11/3047

OTHER PUBLICATIONS

"International Application Serial No. PCT/EP2017/056672, Written Opinion dated Jul. 4, 2017", (dated Jul. 4, 2017), 7 pgs.
"International Application Serial No. PCT/EP2017/056672, International Preliminary Report on Patentability dated Oct. 4, 2018", (dated Oct. 4, 2018), 8 pgs.
"European Application Serial No. 17 712 480.7, Office Action dated Jan. 9, 2020", (dated Jan. 9, 2020), 5 pgs.
"Russian Application Serial No. 2018133255, Office Action dated Apr. 20, 2020", w/ English Translation, (dated Apr. 20, 2020), 8 pgs.
"Russian Application Serial No. 2018133255, Search Report dated Apr. 20, 2020", w/ English Translation, (dated Apr. 20, 2020), 4 pgs.

* cited by examiner

METERING PUMP FOR A METERING DEVICE AND METERING DEVICE

PRIORITY APPLICATIONS

This application is a U.S. National Stage Filing under 35 U.S.C. 371 from International Application No. PCT/EP2017/056672, filed on Mar. 21, 2017, and published as WO2017/162655 on Sep. 28, 2017, which claims the benefit of priority to German Application No. 10 2016 204 953.4, filed on Mar. 24, 2016; the benefit of priority of each of which is hereby claimed herein, and which applications and publication are hereby incorporated herein by reference in their entirety.

The present invention relates to a metering pump for a metering device, the metering pump being connectable to a storage container. The metering pump thereby comprises a non-return valve which has sealing elements on the base-side, which sealing elements enable internal sealing of the metering pump. In addition, the present invention relates to a metering device in which the metering pump according to the invention is connected to a storage container.

Pumps and bottles for preservative-free formulations require precisely-fitting liquid- or air-tight valves. The impermeability of such valves is however based crucially on the fitting precision of the moulded parts which form the basis of corresponding metering pumps. In the meantime, in principle all non-metallic components of metering pumps, in particular also valves etc, are produced by means of injection moulding for reasons of cost. Inaccuracies during the injection moulding work and during the assembly process cause faults however in the fitting precision of the individual components, in particular in the horizontal and/or vertical fitting precision. These constructionally caused faults lead however to the corresponding metering pumps being able to have, in practice, deficient impermeability so that, in the metering pumps or in the metering devices, unintended fluidic flows, for example of a fluid to be dispensed, but also gases, can take place.

In order however to ensure sufficient impermeability, in particular air-impermeability, in the metering devices known from the state of the art, the valve structures are assembled tightly and with little clearance. This and also the above-mentioned faults in the fitting precision lead however to stiffness of the pump. In addition, generally a strong spring is used for the valve closure in order to effect internal sealing by frictional fitting of the components. Also a strong spring can be a further cause for making the operation stiff. It is hereby problematic, in addition, that the previously mentioned reasons can frequently lead to jamming of moveable components in such metering pumps.

It was therefore the object of the invention to develop metering pumps known from the state of the art in such a way as to solve the above-mentioned problems. In particular, the metering pump forming the basis of the invention is intended to be configured such that as high fluidic impermeability as possible is ensured, nevertheless however sufficiently simple mechanical operability is ensured so that strong springs and hence accompanying high operating forces can be dispensed with as far as possible. In addition, a metering pump according to the invention is intended to have a lesser tendency to jamming.

This object is achieved, with respect to a metering pump, by the features of patent claim 1, with respect to a metering device, by the features of patent claim 17. The respectively dependent patent claims thereby represent advantageous developments.

The invention hence relates to a metering pump for a metering device for metered dispensing of a liquid which is connectable to a storage container, comprising a cylindrical pump body which comprises a first hollow cylindrical pump body portion which is open in the direction of the storage container and a second hollow cylindrical pump body portion which is open in the direction of an actuation body, an inner hollow cylinder which is open at both ends, is mounted on the first pump body portion and is disposed concentrically to the latter, a plunger which has a continuous channel, is mounted concentrically in the pump body and moveably in the inner hollow cylinder, and is configured to form a seal with an inner wall of the inner hollow cylinder, and also an actuation body which is connected to the pump body and mounted moveably relative to the pump body, which actuation body has, on an upper end, an outlet for liquid and a recess which is open in the direction of the second pump body portion, a liner being received inside the recess of the actuation body, which liner has a recess which is open in the direction of the second pump body portion, the liner being disposed or being disposable to form a fluidic seal relative to the plunger and having a liquid channel through which a liquid can be guided from the recess of the liner to the outlet of the actuation body, a non-return valve which is mounted moveably and configured to form a fluidic seal relative to the recess of the liner being disposed inside the recess, which non-return valve, in the unactuated state of the metering pump, fluidically seals the channel of the plunger relative to the recess of the liner and opens the channel of the plunger and also the liquid channel of the liner during actuation of the metering pump, the non-return valve having at least one sealing element which enables fluidic sealing of the non-return valve relative to the plunger.

Hence, the present invention relates to a metering pump which, mounted together with a storage container, produces a metering device.

The essential components of the metering pump are thereby:

- a cylindrical pump body. The cylindrical pump body is thereby subdivided into two functional portions and has a first hollow cylindrical pump body portion which, at the bottom, is configured open in the direction of the storage container to be fitted. In addition, the cylindrical pump body has a second open hollow cylindrical pump body portion which, at the top, is configured open in the direction of an actuation body which is to be fitted or is fitted.

The cylindrical pump body can have a guide element in its centre, i.e. between both portions, with which a plunger can be guided within the cylindrical pump body.

- an open inner hollow cylinder. The open inner hollow cylinder is fixed at the lower, first pump body portion and disposed concentrically with the latter. The concentric arrangement leads to the cylindrical recess of the pump body and of the hollow cylinder being disposed axially relative to each other.
- a plunger. The plunger is thereby configured as hollow plunger and has a continuous channel. The plunger is thereby dimensioned such that it can be guided concentrically into the pump body and the hollow cylinder fixed on the pump body. The plunger is disposed moveably in the pump body and in the hollow cylinder and is thereby configured, at least at its lower end, to form a seal relative to the inner wall of the inner hollow cylinder. Because of its moveability, a hollow volume can thereby be configured in the inner hollow cylinder, which can also be termed "pump chamber".

an actuation body. The actuation body is connected to the upper part of the hollow cylindrical pump body, to the second pump body portion or can be connected to the latter. The actuation body is thereby mounted moveably relative to the pump body. The actuation body thereby has an outlet for liquid at its upper end. Within the actuation body, a recess is configured which is open in the direction of the second pump body portion and into which a liner can be received. By moving, e.g. pressing, the actuation body in the direction of the pump body, the metering pump can thereby be actuated for dispensing a liquid.

a liner. The liner is thereby received in the recess of the pump body provided for this purpose. The liner thereby has, for its part, a recess in which a non-return valve can be received. In addition, the liner has a liquid channel via which liquid can be guided from the recess of the liner to the outlet on the actuation body. The liquid channel is thereby preferably guided from the recess through the wall of the liner and extends along the outer surface of the liner in the direction of the outlet. The liner is thereby disposed to form a fluidic seal relative to the plunger by being seated, with its lower end, for example on the upper end of the hollow plunger and (e.g. constructionally caused by corresponding dimensioning of the recess of the actuation body and of the liner) being retained in position there.

a non-return valve. Within the recess of the liner, a moveably mounted non-return valve which is configured to form a fluidic seal relative to the recess of the liner is disposed. The non-return valve can thereby be actuated within the recess such that the channel is sealed fluidically by the non-return valve in the unactuated state, during actuation, the non-return valve is deflected out of its inoperative position by the liquid flow such that the channel of the liner is opened and liquid can flow from the storage container through the channel of the plunger in the direction of the outlet opening in the actuation body.

The invention is distinguished by at least one sealing element being disposed, on the base-side, on the non-return valve, which sealing element enables fluidic sealing of the non-return valve relative to the plunger.

The non-return valve hence enables an additional or particularly efficient sealing of the plunger, and in particular of the hollow volume of the plunger relative to the recess of the liner. By means of this additional sealing, manufacturing faults due to manufacture can be compensated for so that, even in the case of non-ideal geometric configuration or arrangement of all the components of the metering pump, an efficient sealing of the inner flow path of the liquid and/or gases to be metered in is ensured.

It is hereby particularly advantageous that the non-return valve makes possible the fluidic sealing via the at least one sealing element by means of a suction force acting on the non-return valve through the channel of the plunger on the non-return valve at the end of the actuation process. The sealing is hence effected as soon as the sealing element has made contact with the wall or the neck of the plunger. By means of the stroke process of the plunger at the end of the actuation process of the metering pump, liquid is thereby suctioned again into the pump chamber out of the storage container. By means of the stroke process of the plunger, there is produced thereby within the channel of the plunger and also in the pump chamber, a low pressure by means of which it is made possible for liquid to be suctioned again out of the storage container. On the other hand, this low pressure also acts on the non-return valve (the so-called "suction force") which is suctioned consequently against the plunger. In particular in the case of a flexible or elastic configuration of the sealing elements, such as for example in the form of sealing lips, improved sealing is consequently possible.

A preferred embodiment hence provides that the sealing element has an elastic configuration.

It is advantageous in particular if the at least one sealing element is configured as sealing lip, in particular as sealing lip which encloses the channel of the plunger concentrically or can be introduced partially into the channel.

Furthermore, it is advantageous if, in the unactuated state of the metering pump, the at least one sealing element forms a seal with the wall of the plunger in a form-fit and/or engages in the channel of the plunger.

It is further preferred that at least one sealing element on the non-return valve is configured in one piece with the non-return valve or is moulded onto the non-return valve. A one-piece configuration can be achieved for example by the complete non-return valve including the associated sealing element, such as for example sealing lip, being produced in an injection moulding method. In this embodiment, the sealing element and the non-return valve are formed preferably from the same materials. On the other hand, it can likewise be possible to mould one or more sealing elements on the non-return valve. In this embodiment, it can be the case that sealing element and non-return valve are formed from different material chambers but also from the same materials.

The at least one sealing element can have a height salient in the direction of the plunger of 0.3 to 5.0 mm, preferably of 0.5 to 2.0 mm and/or thickness or width of 0.05 to 3.0 mm, preferably of 0.1 to 1.5 mm.

A further preferred embodiment provides that the at least one sealing element (151, 152) is disposed on the base-side on the non-return valve (150) and preferably is disposed, with respect to the base of the non-return valve (150), at an angle of 5 to 175°, preferably 45 to 135°, further preferably 80 to 100°, in particular 90°.

Furthermore, it is advantageous if the at least one sealing element is formed from a thermoplastic material, in particular from a polyolefin, such as e.g. polyethylene, polypropylene, polystyrene, from an elastomeric material, in particular rubber, or from a thermoplastic elastomer, in particular TPE-U.

It can hereby be provided that the at least one sealing element is formed from the same material as the non-return valve.

Preferably, the non-return valve is retained by an elastic element which exerts a restoring force on the non-return valve which acts in the direction of the plunger, in particular a spring, in the non-actuated state in a fluidically sealing position relative to the channel of the plunger and also the liquid channel of the liner.

In addition, it is possible that an element is disposed between actuation body and pump body and exerts a restoring force on the actuation body during and/or after actuation, in particular a spring element.

The first pump body portion can have a device for fixing the storage container. This device can be configured for example as a snap-on connection or else as a screw-on connection. In this case, both the storage container and the first pump body portion have corresponding elements for corresponding fixing of the storage container.

In addition, it is advantageous if a seal is disposed in the region of the first pump body portion which seals the storage container relative to the metering pump. The seal can be disposed e.g. in a recess of the first pump body portion, provided for this purpose.

A further preferred embodiment provides that the inner hollow cylinder has a valve portion at its end which is open in the direction of the storage container and in which an inlet valve, which is configured in particular as disc valve or ball valve, is disposed.

Furthermore, it is advantageous that a riser pipe is disposed at the end of the inner hollow cylinder which is open in the direction of the storage container. The riser pipe can thereby be dimensioned such that it reaches as far as the base of a storage container fixed to the metering pump.

Between the outside of the plunger and the inside of the second pump body portion, a sealing element can be disposed on the inside of the second pump body portion for sealing the plunger. Such a seal is described in detail in DE 10 2009 099 262. All the embodiments relating to this sealing element apply also without restriction for the present invention. The disclosure content of this patent application is made applicable by reference to the subject of the present patent application.

In addition, the present invention relates to a metering device which comprises a previously described metering pump according to the invention and also to a storage container, metering pump and storage container being connected together to form the metering device.

Storage container and metering pump can thereby be connected together to form the metering device, for example by means of a snap-on connection, but also by means of a screw-on connection.

In particular, the metering device can be configured as a non-pressure-equalising metering device or as a pressure-equalising metering device.

The present invention is described in more detail with reference to the subsequent embodiments and Figures without restricting the present invention to the illustrated special embodiments.

There are hereby shown:

FIG. 1 a metering device according to the invention.

Figure 2:
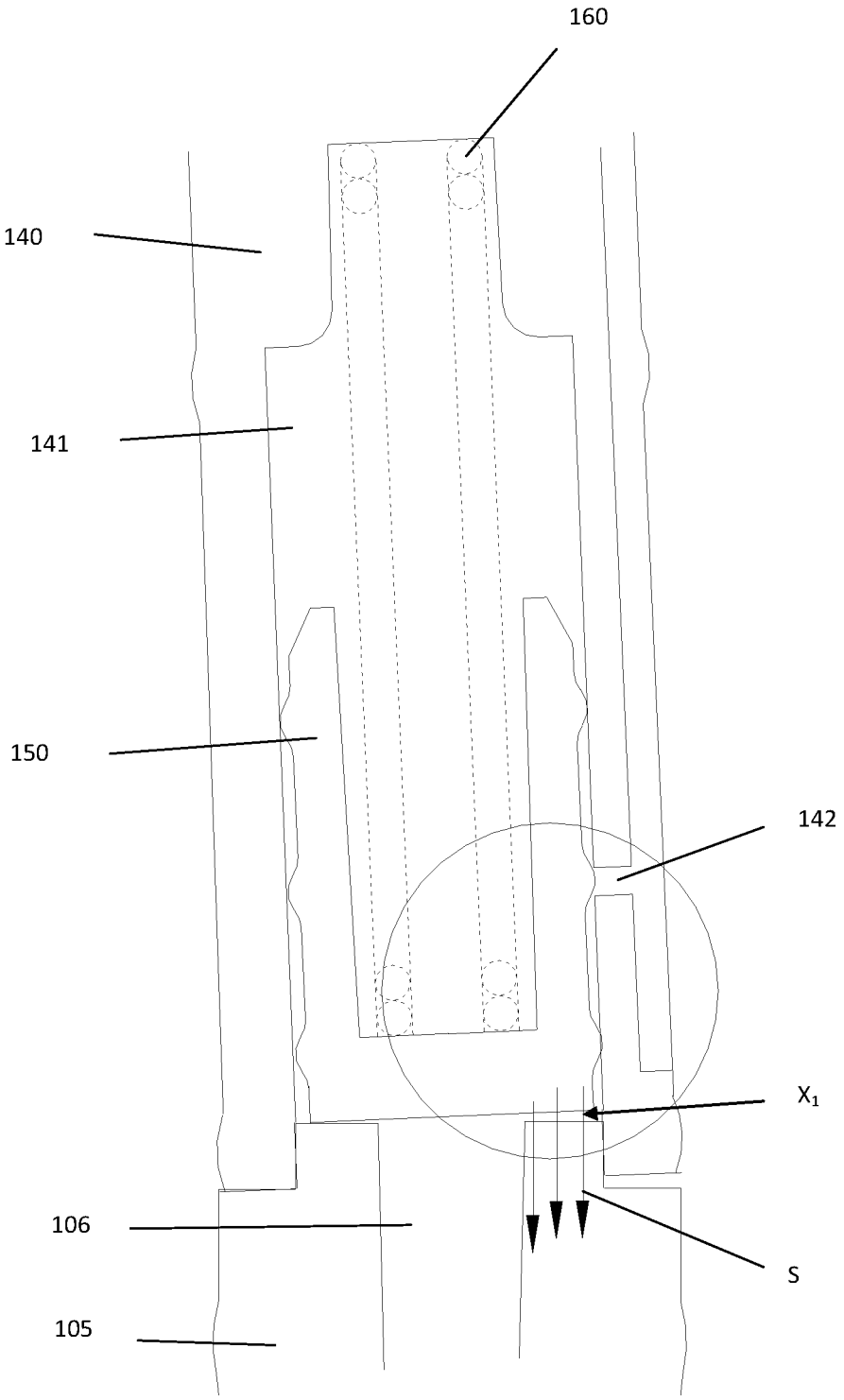

FIG. 2 a section of a metering pump according to the state of the art.

Figure 3:
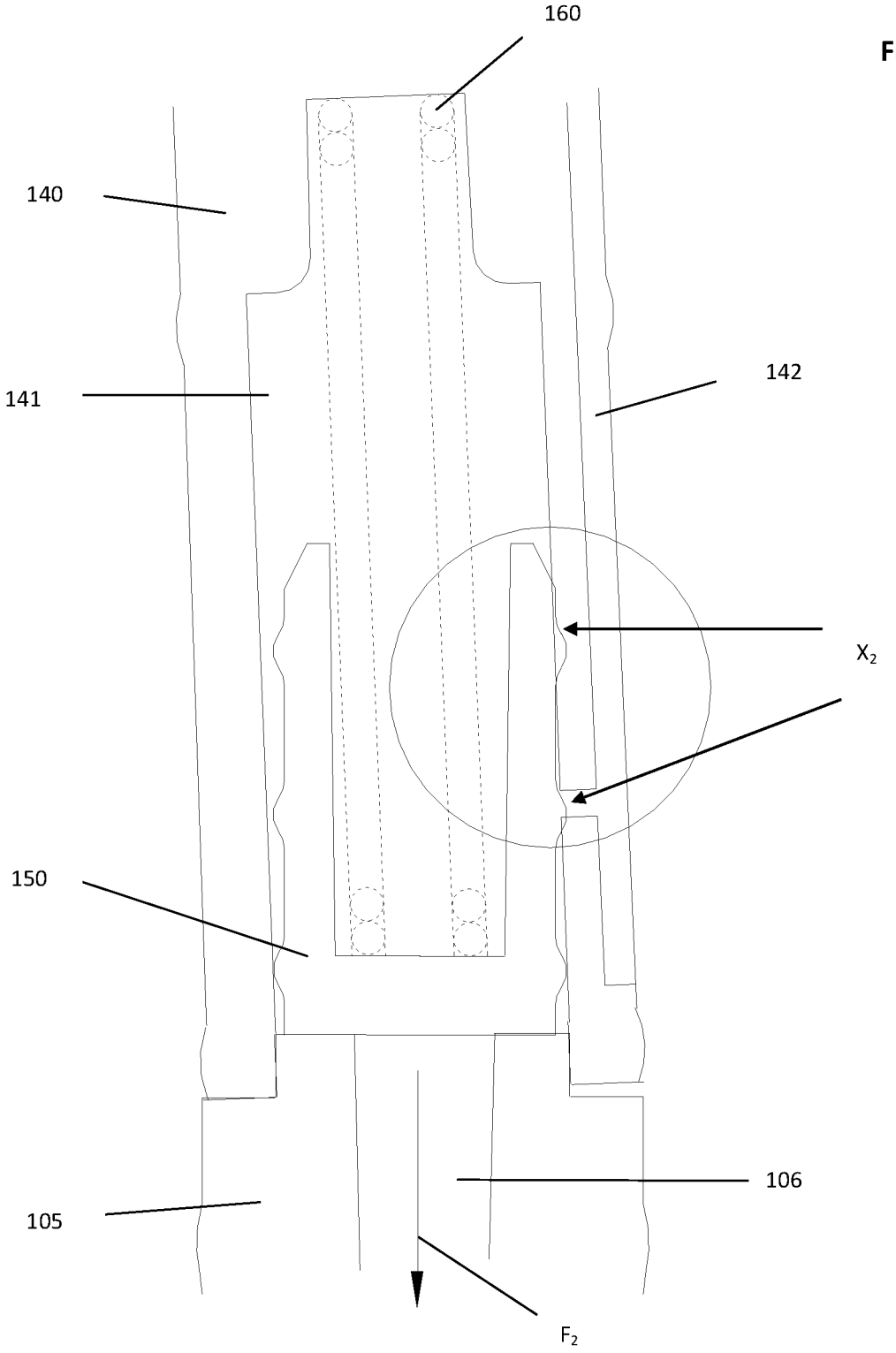

FIG. 3 a section of a metering pump according to the state of the art.

Figure 4:
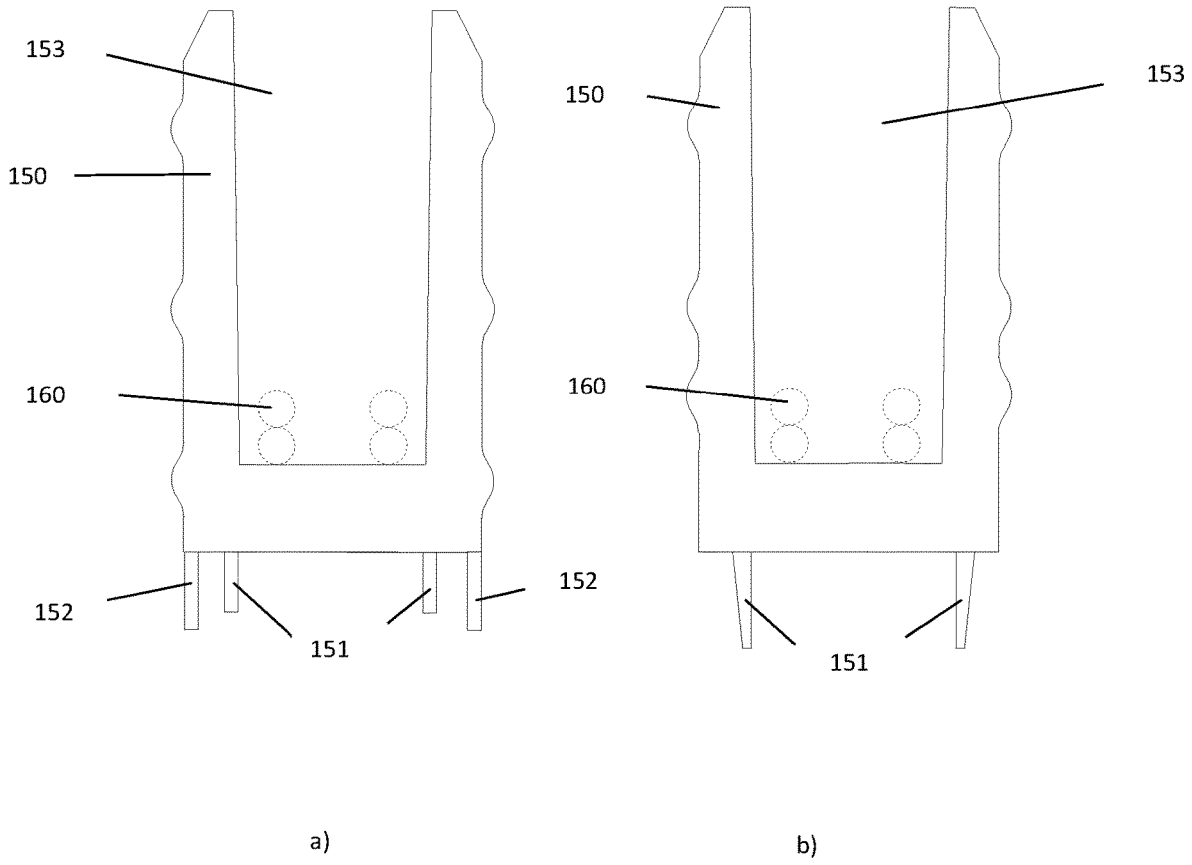

FIG. 4 various embodiments of a non-return valve for use in a metering pump according to the invention.

Figure 5:
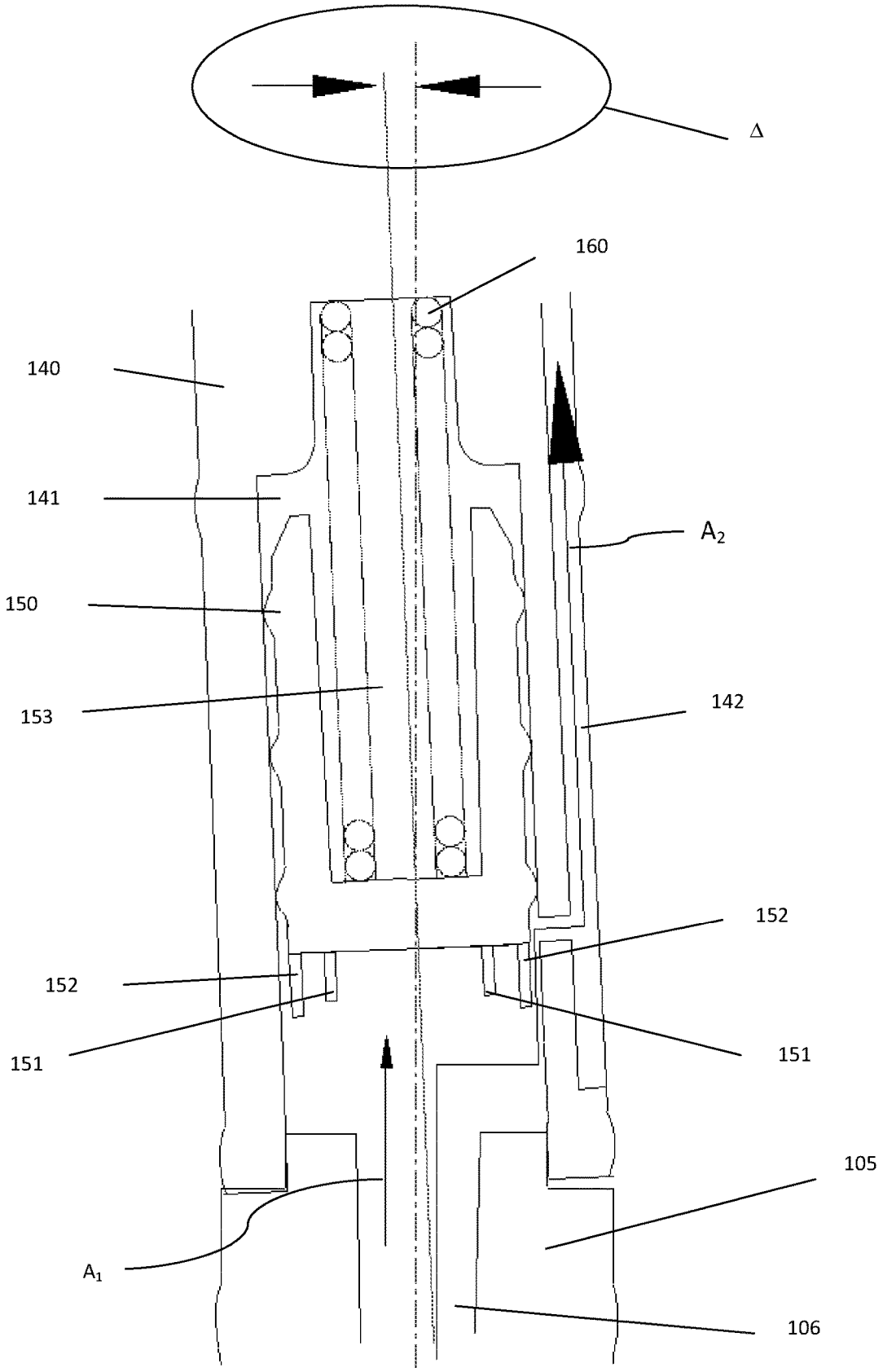

FIG. 5 the metering pump according to the invention in opened state.

Figure 6:
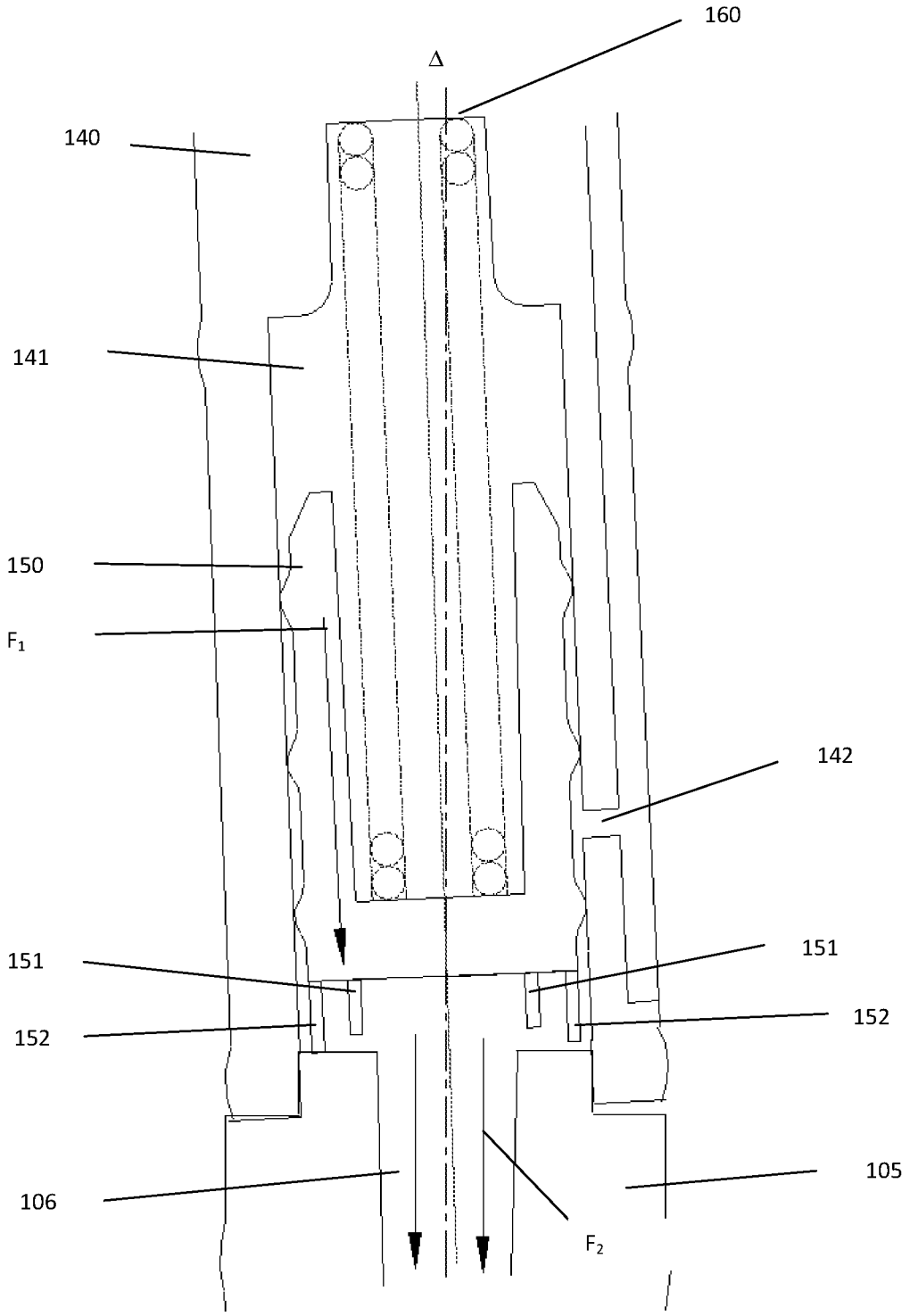

FIG. 6 the metering pump according to the invention in almost closed state.

Figure 7:
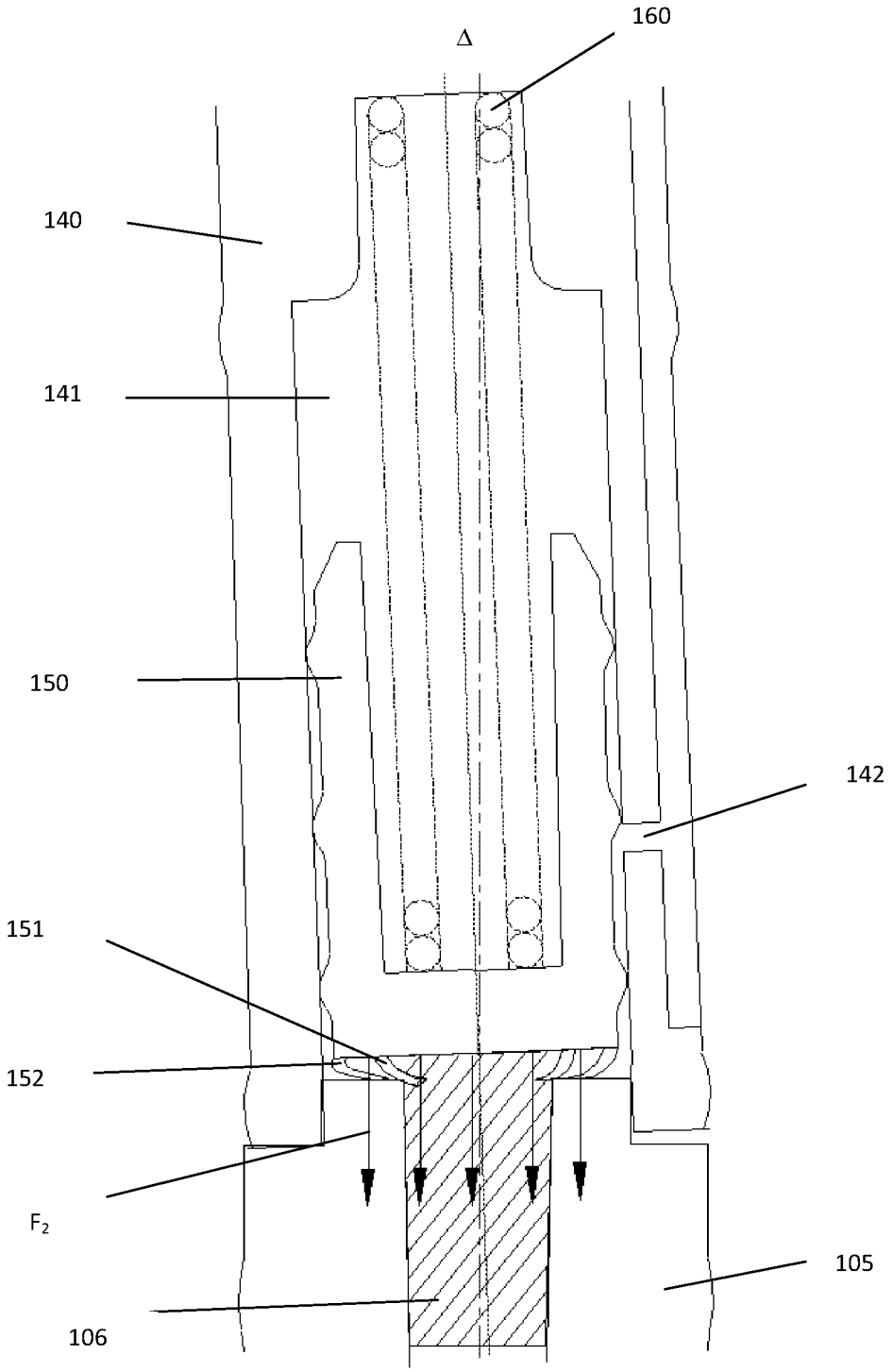

FIG. 7 the metering pump according to the invention in closed state.

Figure 8:
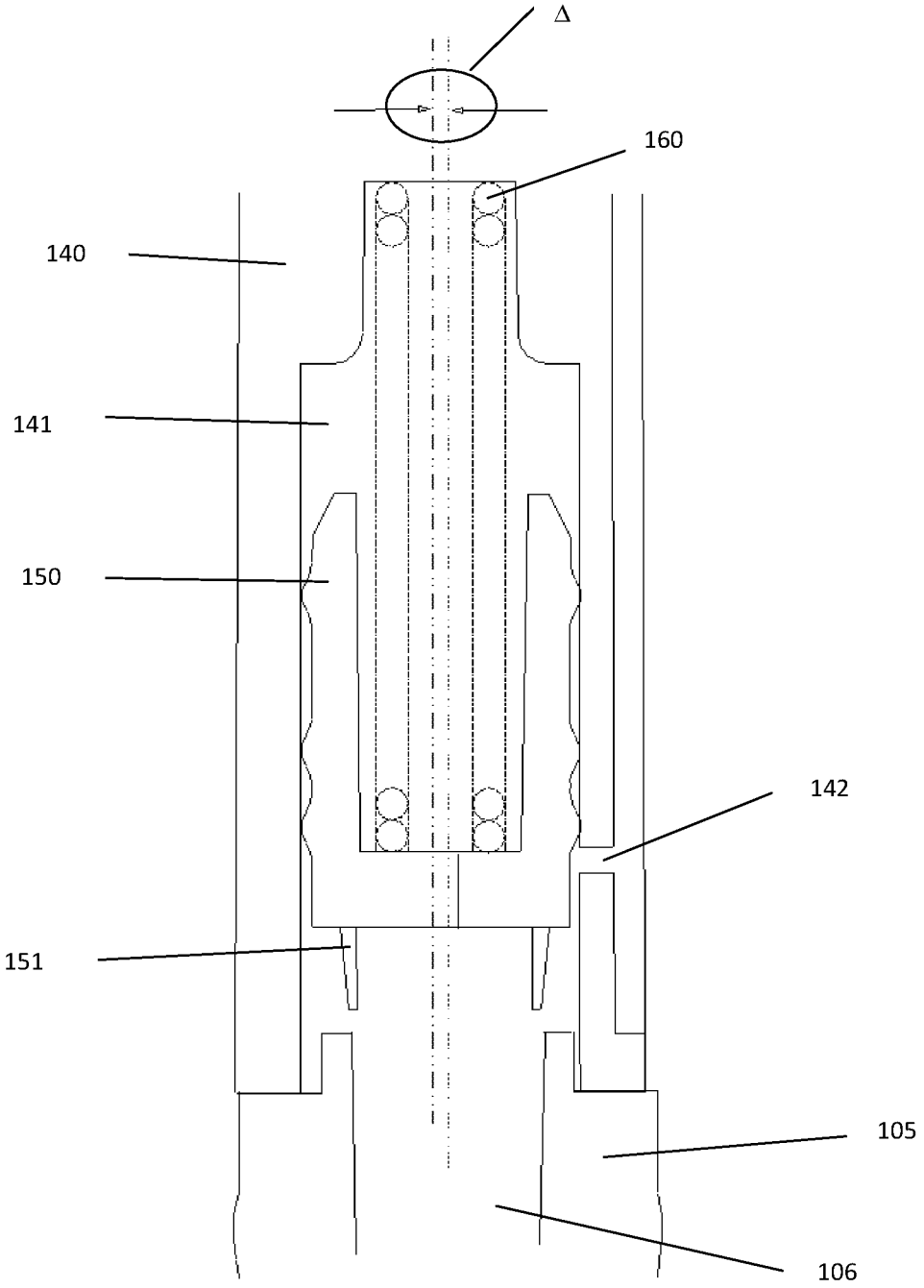

FIG. 8 a further embodiment of a metering pump according to the invention in opened state.

Figure 9:
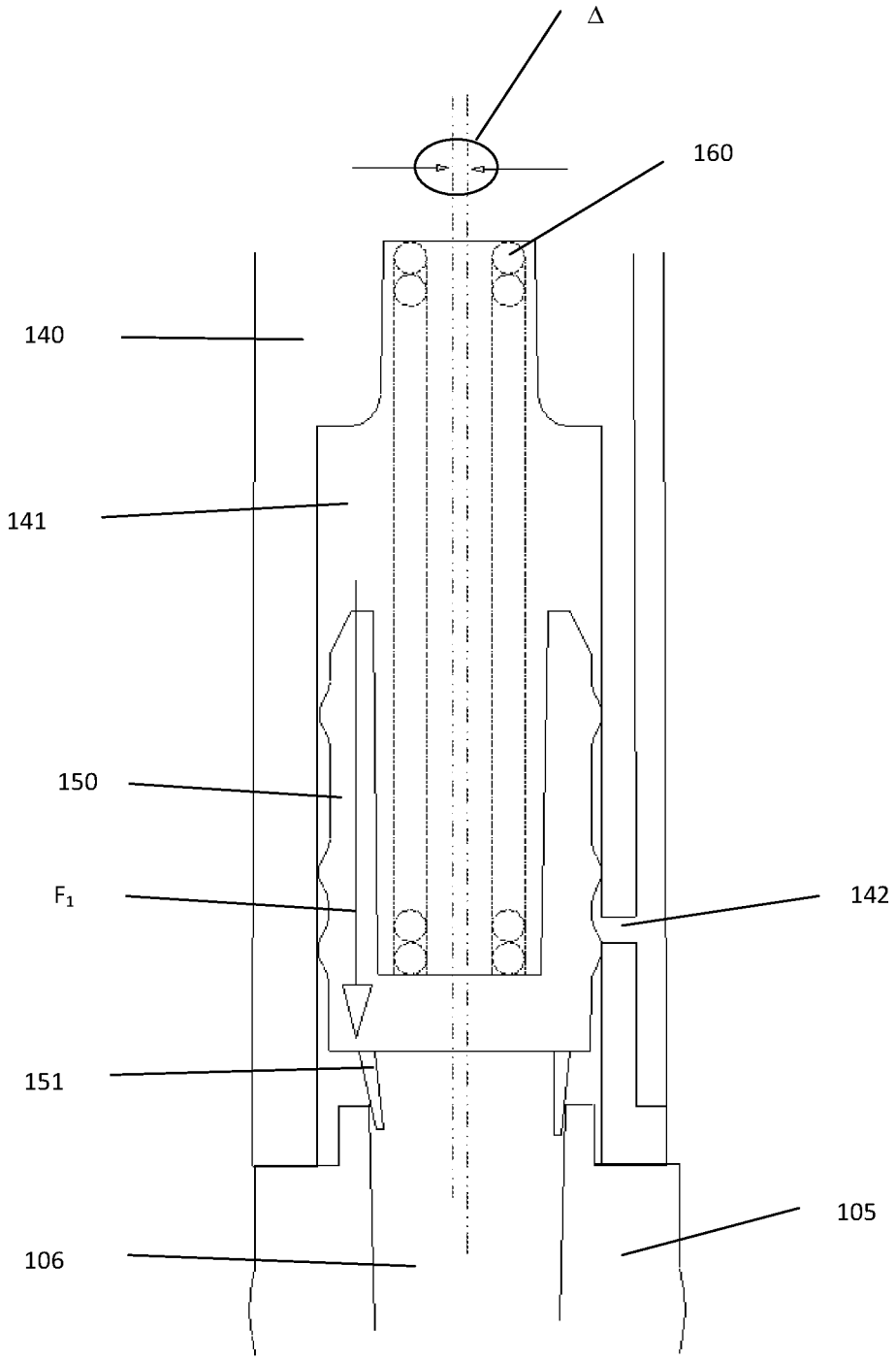

FIG. 9 the metering pump according to FIG. 9 in almost closed state.

Figure 10:
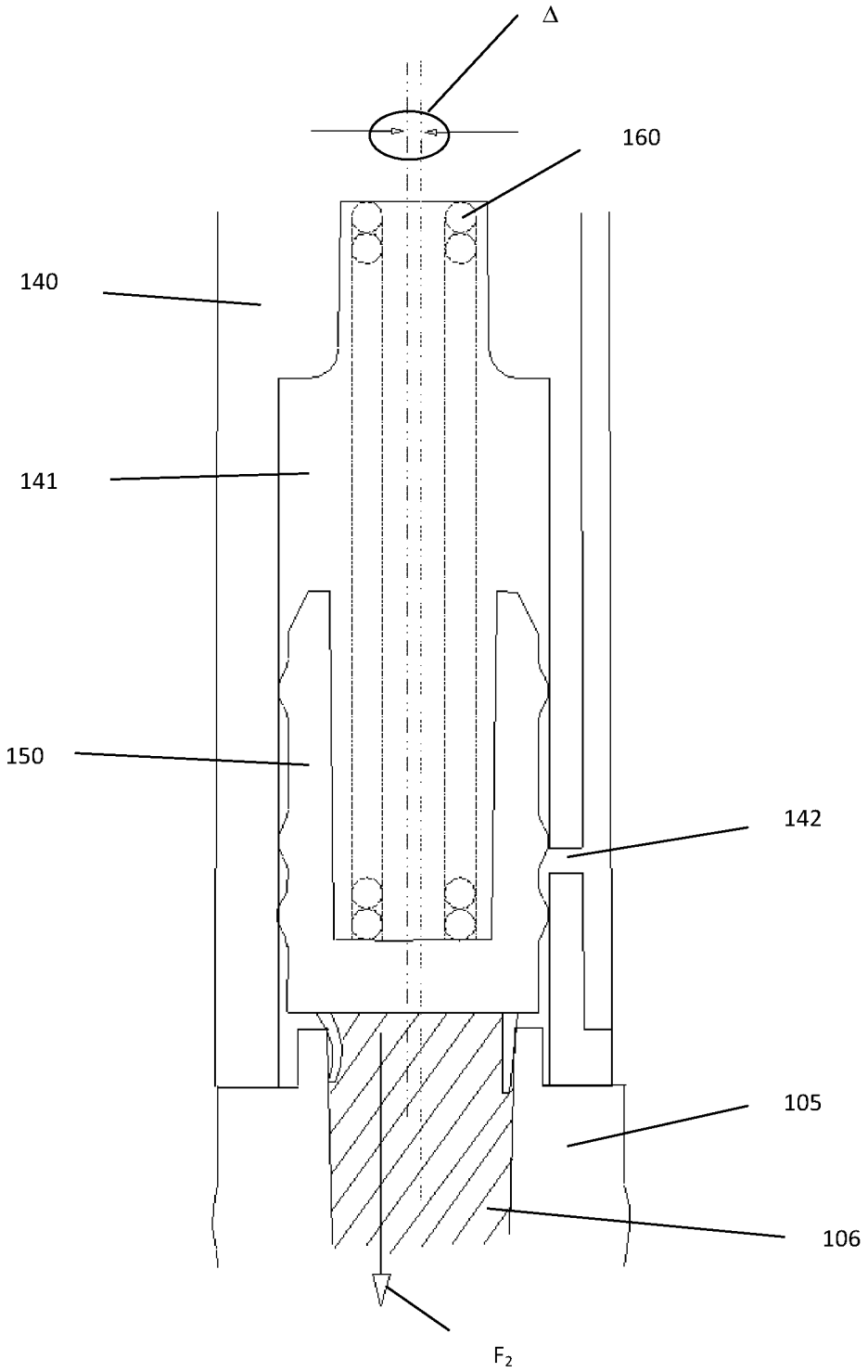

FIG. 10 the metering pump according to the invention in completely closed state.

In the subsequent Figures, the same components are always characterised with the same reference numbers.

The metering device 300 according to the invention, illustrated in FIG. 1, has a metering pump 100 which is mounted on a storage container 200. The metering pump according to the invention thereby consists of a cylindrical pump body 110 which has a lower portion 111 and an upper portion 112. On the lower portion 111, an inner hollow cylinder 120 is thereby fixed and can be connected to the pump body 110, for example via a snap-on connection. The cylindrical pump body 110 and the inner hollow cylinder 120 thereby have a concentric recess in which a hollow plunger 105 with an inner hollow volume 106 can be guided moveably upwards and downwards. On the upper pump body portion 112, an actuation body 130 is thereby fixed and is retained in the position illustrated in FIG. 1 by a restoring force via a spring element 170. The actuation body 130 thereby has a recess 132 within which a liner 140 is fixed. The liner 140 thereby likewise has a recess 141 which is configured open at the bottom. The liner has in addition a liquid channel 142 which is in communication with the outlet 131 in the actuation body 130. The liquid channel 142 can thereby guide fluid from the recess 141 of the liner 140 through the wall thereof towards the outlet 131. The liquid channel 142 is thereby preferably configured as recess in the outer wall of the liner 140. Via the above-disposed outlet 131, any fluid to be dispensed can emerge outwards from the metering device upon actuation of the actuation body 130. Within the recess 141 of the liner 140, a non-return valve 150 is thereby disposed moveably and is pressed downwards in the recess 141, for example via a restoring spring 160. The non-return valve 150 is thereby pressed onto the upper end of the plunger 105 by the spring 160 in the inoperative position of the metering device and hence closes the continuous recess 106 of the plunger 105. The actuation body 130 is configured relative to the cylindrical pump body by means a restoring spring 170. The downwardly open hollow cylindrical pump body portion 111 thereby has an inlet valve at its lower end, for example a disc valve 121.

Upon actuation of the actuation body 130, i.e. upon pressing the actuation body 130 in the direction of the cylindrical pump body 110, the plunger 105 is hence likewise pressed downwards. The volume (pump chamber 122) enclosed by the lower end of the plunger 105 in the inner hollow cylinder 120 is hereby minimised so that any fluid enclosed therein flows through the channel 106 of the plunger 105 upwards in the direction of the liner 140. By means of the increasing pressure, the non-return valve 150 is thereby moved upwards in the liner 140, the flow channel 142 is opened so that liquid can flow in the direction of the outlet 131 and flows out there. The spring 170 ensures, at the end of the actuation process, a restoring force which acts on the actuation body 130 and moves the latter back from the pump body 110 into its inoperative position, as illustrated in FIG. 1. As a result, also the plunger 105 is moved upwards so that a low pressure is formed in the pump chamber 122, i.e. in the volume formed by the plunger 105 within the inner hollow cylinder. By means of the inlet valve 121, the volume of this pump chamber is hence filled again after resuctioning the liquid stored in the storage container 200. The storage container 200 is thereby connected by means of a seal 180 to form a seal relative to the pump body 110 with the latter. On the upper side, the actuation body can be closed with a removable cap 190 so that the outlet 131, when not in use, can be protected for example from soiling and/or drying out. It is thereby essential to the invention that the non-return valve 150 has sealing elements, for example sealing lips 151 and 152 which enable sealing of the non-return valve relative to the plunger 105 and hence relative to the channel 106 of the plunger 105.

The frame I framing the recess 141 of the liner 142 in FIG. 1 is illustrated in an enlarged construction (with the exception of FIG. 4) in the subsequent Figures.

FIG. 2 shows an embodiment of a non-return valve 150 which is disposed in the liner 140, as is known from the state of the art. Here also, the liner 140 has a recess 141 which is open at the bottom and within which the non-return valve 150 is disposed. The liner 140 thereby sits on the plunger 105, the non-return valve 150 is thereby intended likewise to form a seal with the upper edge of the plunger 105. The non-return valve 150 is thereby pressed against the upper edge of the plunger 105 by a spring element 160. The non-return valve 150 thereby has however no sealing elements. In FIG. 2 a typical situation from practice is illustrated, in which for example production faults and/or production-caused distortion of some components, for example of the plunger 105 and/or of the liner 140, lead to a defect $X_1$ being present, at which for example the liner 140 does not form a coherent and form-fit seal with the plunger 105. Also the non-return valve 150 guided therein is hence not configured absolutely in a form-fit with the upper end of the plunger 105 in the closed position so that the sealing function of the non-return valve is formed simply incorrectly. Hence the result is formation of a defect $X_1$ at which no satisfactory sealing function of the non-return valve 150 is ensured. For example, undesired flows of liquid and/or gases which are caused by suction forces S can hereby take place, which flows enable undesired fluidic communication between the outlet channel 142 and the channel 106 of the plunger 105 in the closed state of the metering pump or of the metering device.

This defect shown in FIG. 2 can lead, furthermore, to the problem shown in FIG. 3. As a result of the suction force S illustrated in FIG. 2, the non-return valve 150 can be pressed entirely and correctly against the plunger 105 or can be suctioned by the occurring suction force $F_2$, however the result is a defect, denoted with $X_2$, namely tilting of the non-return valve 150 within the liner 140. It can hereby be provided that, because of the tilting of the non-return valve 150 taking place, no movement of the non-return valve 150 upwards is effected upon actuation of the metering pump and hence the fluid channel 142 is not opened. Upon actuation of the metering pump, no liquid thereby emerges from the metering pump.

These faults can be eliminated by inserting a modified non-return valve 150, as illustrated in FIG. 4, in the metering pump according to the invention. The non-return valve is thereby configured, as illustrated in FIG. 2 or 3, and can have for example an inner recess 153 in which the spring element 160 engages. On the lower side, i.e. on the base of the non-return valve 150, two sealing lips 151 and 152 (FIG. 4*a*) or one sealing lip 151 (FIG. 4*b*) are thereby fitted. The two-dimensional illustration of the non-return valve 150, illustrated in FIG. 4, should thereby be understood such that the sealing lips represent concentric circles which can surround the cylindrical recess of the plunger 105 or can engage in the latter. The precise mode of operation of these sealing elements in the form of sealing lips is explained in more detail in the subsequent illustrations. The sealing element or elements 151, 152 are thereby configured normally to the base of the non-return valve 150.

FIG. 5 shows an embodiment of a metering pump or metering device according to the invention which in principle follows the configuration as illustrated in FIG. 2. In contrast to the embodiment of FIG. 2, the metering pump or metering device according to FIG. 5 includes however a non-return valve 150 as described in FIG. 4*a*. In FIG. 5, the open position of the metering pump is illustrated, the non-return valve 150 in the recess 141 of the liner 140 moving the non-return valve 150 upwards as a result of the high pressure of the liquid flowing from the bottom through the recess 106 of the plunger 105 (arrow $A_1$). The liquid channel 142 is hereby opened by the non-return valve 150 so that liquid can flow through the liquid channel 142 upwards in the direction of the outlet (arrow $A_2$). The non-return valve 150 has two sealing lips 151 and 152 moulded on the base. As in FIG. 2, here also the liner 140 is not disposed ideally on the plunger 105 so that the same defect, as indicated in FIG. 2, results. The deviation of the axial orientation of the liner 140 relative to the axial orientation of the plunger 105 is indicated with Δ.

FIG. 6 shows a position of the non-return valve 150, after the actuation process and hence the dispensing of liquid by the metering pump has ended. As a result of the restoring spring force $F_1$ of the spring 160, the non-return valve 150 is moved in the direction of the plunger 105. By means of the plunger 105 moving upwards at the end of the metering process (see FIG. 1), a low pressure is produced in the pump chamber which ensures, on the one hand, that again liquid can flow from the storage container into the pump chamber via the valve 121. On the other hand, the low pressure which continues over the cylindrical volume 106 of the plunger 105 has the effect also that a restoring force $F_2$ (the so-called "suction force") acts on the non-return valve 150. This leads to the non-return valve being suctioned against the plunger 105, despite any existing manufacturing faults or possibly lower strength of the spring 160. Because of the elasticity of the sealing lips 151 and 152, this can lead to the sealing elements being deformed and for example folding down or buckling and hence being pressed rigidly against the plunger 105.

This state is illustrated in FIG. 7, the plunger is hereby suctioned completely against the plunger 105 by the force (suction force) acting as a result of the low pressure $F_2$ produced at the end of the actuation process. Although hence no ideal geometric arrangement of the liner 140 relative to the plunger 105 is provided (see Δ), complete sealing of the plunger 105 relative to the recess 141 of the liner can be produced.

In FIG. 8 the mode of operation of an alternative embodiment of a non-return valve 150, as illustrated in FIG. 4*b*, is described. FIG. 8 represents an analogous embodiment to FIG. 5, here also the metering pump is illustrated in the opened state. In contrast to FIG. 5, the non-return valve 150 hereby comprises only one sealing lip 151 which is configured however, in its longitudinal dimension (i.e. the height or the dimension in the direction of the plunger 105) like the embodiment of the sealing valve 150 according to FIG. 4*a*. In FIG. 8, a further typical manufacturing fault is illustrated. The liner 140 is hereby offset laterally relative to the plunger 105.

Upon closure of the non-return valve 150 at the end of the actuation process—as illustrated in FIG. 9—analogously to FIG. 6, the non-return valve 150 is pressed in the direction of the plunger 105 by spring force (reference number $F_1$) of the restoring spring 160. The sealing lip 151 is thereby configured such that a geometrical engagement in the channel 106 of the plunger 105 is made possible. The sealing lip is hence introduced into the channel 106 and pressed against the wall of the plunger 105 because of its elasticity. There hereby results, because of the sealing (see FIG. 10, reference number $F_2$), also the effect of the low pressure produced in the pump chamber so that, as a result of this suction force, further suctioning of the non-return valve 150 onto the plunger 105 is effected and hence secure sealing of the plunger 105 relative to the inner recess 141 of the liner 140 is made possible. An increase in the force of the spring 160 is hence not required.

The invention claimed is:

1. A metering pump for a metering device for metered dispensing of a liquid which is connectable to a storage container, the metering pump comprising:

a cylindrical pump body which comprises a first hollow cylindrical pump body portion which is open in the direction of the storage container and a second hollow cylindrical pump body portion which is open in the direction of an actuation body;

an inner hollow cylinder which is open at both ends which is mounted on the first pump body portion and is arranged concentrically to the first pump body portion;

a plunger which has a thoroughgoing channel which is mounted concentrically in the pump body and moveably in the inner hollow cylinder, and is configured to form a seal with an inner wall of the inner hollow cylinder;

an actuation body which is connected to the pump body and mounted moveably relative to the pump body, wherein the actuation body has, on an upper end, an outlet for liquid and a recess which is open in the direction of the second pump body portion, wherein a liner is received inside the recess, wherein the liner has a recess which is open in the direction of the second pump body portion, the liner being disposed to form a fluidic seal relative to the plunger and having a liquid channel through which a liquid can be guided from the recess of the liner to the outlet of the actuation body; and a non-return valve which is mounted moveably and configured to form a fluidic seal relative to the recess of the liner being disposed inside the recess of the liner, wherein the non-return valve, in the unactuated state of the metering pump, fluidically seals the channel of the plunger relative to the recess of the liner and opens the channel of the plunger and also the liquid channel of the liner during actuation of the metering pump, the non-return valve having at least one sealing element which enables fluidic sealing of the non-return valve relative to the plunger, wherein the at least one sealing element is disposed on the base-side on the non-return valve at an angle of 5 degrees to 175 degrees with respect to the base of the non-return valve.

2. The metering pump according to claim 1, wherein the non-return valve is configured to provide the fluidic sealing via the at least one sealing element via a suction force acting on the non-return valve through the channel of the plunger on the non-return valve at the end of the actuation process.

3. The metering pump according to claim 1, wherein the at least one sealing element has an elastic configuration.

4. The metering pump according to claim 1, wherein the at least one sealing element is configured as a sealing lip.

5. The metering pump according to claim 1, wherein, in the unactuated state of the metering pump, the at least one sealing element forms a seal with the wall of the plunger in a form-fit and/or engages in the channel of the plunger.

6. The metering pump according to claim 1, wherein the least one sealing element on the non-return valve is configured in one piece with the non-return valve or is moulded onto the non-return valve.

7. The metering pump according to claim 1, wherein the at least one sealing element has a height in the direction of the plunger of 0.3 to 5.0 mm.

8. The metering pump according to claim 1, wherein the at least one sealing element includes at least one of a thermoplastic material, an elastomeric material, or a thermoplastic elastomer.

9. The metering pump according to claim 1, wherein the non-return valve is retained by an elastic element which exerts a restoring force on the non-return valve in the non-actuated state in a fluidically sealing position relative to the channel of the plunger and also the liquid channel of the liner.

10. The metering pump according to claim 1, wherein a spring element is disposed between actuation body and pump body and exerts a restoring force on the actuation body during and/or after actuation.

11. The metering pump according to claim 1, wherein the first pump body portion has a device for fixing the storage container.

12. The metering pump according to claim 1, wherein a seal is disposed in the region of the first pump body portion which seals the storage container relative to the metering pump.

13. The metering pump according to claim 1, wherein the inner hollow cylinder has a valve portion at the end of the inner hollow cylinder which is open in the direction of the storage container and in which an inlet valve is disposed.

14. The metering pump according to claim 1, wherein a riser pipe is disposed at the end of the inner hollow cylinder which is open in the direction of the storage container.

15. The metering pump according to claim 1, wherein, between the outside of the plunger and the inside of the second pump body portion, a sealing element is disposed on the inside of the second pump body portion for sealing the plunger.

16. A metering device comprising a metering pump according to claim 1 and also a storage container connected to the metering pump.

17. The metering device according to claim 16, wherein the metering device is configured as a non-pressure-equalising metering device.

18. The metering device of claim 16, wherein the metering device is configured as a pressure-equalizing metering device.

* * * * *